US007533958B2

(12) United States Patent
Park et al.

(10) Patent No.: US 7,533,958 B2
(45) Date of Patent: May 19, 2009

(54) SERVICE STATION SYSTEM FOR AN INKJET PRINTER

(75) Inventors: Jin-Ho Park, Yongin (KR); Karp-sik Youn, Hwaseong-gun (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 820 days.

(21) Appl. No.: 10/779,751

(22) Filed: Feb. 18, 2004

(65) Prior Publication Data

US 2004/0174409 A1 Sep. 9, 2004

(30) Foreign Application Priority Data

Mar. 7, 2003 (KR) ..... 10-2003-0014393

(51) Int. Cl.
*B41J 2/165* (2006.01)

(52) U.S. Cl. ..... 347/29; 347/32; 347/33

(58) Field of Classification Search ..... 347/23, 347/29, 32, 33
See application file for complete search history.

(56) References Cited

U.S. PATENT DOCUMENTS 5,663,751 A * 9/1997 Holbrook ..... 347/22
6,132,026 A * 10/2000 Taylor et al. ..... 347/32
6,203,136 B1 * 3/2001 Takahashi et al. ..... 347/32
6,270,183 B1 * 8/2001 Gaarder ..... 347/29
6,334,663 B1 * 1/2002 Lee ..... 347/29
6,474,774 B1 * 11/2002 Okamoto ..... 347/32
6,629,749 B2 * 10/2003 Miyauchi et al. ..... 347/32
6,679,579 B1 * 1/2004 Tee et al. ..... 347/33
2002/0105560 A1 * 8/2002 Shimizu et al. ..... 347/29
2003/0090535 A1 * 5/2003 Park ..... 347/29

* cited by examiner

*Primary Examiner*—Julian D Huffman
*Assistant Examiner*—Jason S Uhlenhake
(74) *Attorney, Agent, or Firm*—Staas & Halsey LLP

(57) ABSTRACT

A service station system for an inkjet printer includes head caps to revolve between a capping position and an uncapping position of printer heads, a slider to slide with respect to the head caps and having wipers mounted on a front end portion thereof. The service station system also includes a slider movement unit to slide the slider, and a revolution unit disposed between the head caps and the slider, to revolve the head caps in association with the sliding of the slider with respect to the head caps. Accordingly, services for the printer heads may be systematically carried out in a relatively small space, and in particular, a compact and small-sized service station system is provided so that a volume from front to rear of an inkjet printer may be reduced.

19 Claims, 7 Drawing Sheets

SERVICE STATION SYSTEM FOR AN INKJET PRINTER

CROSS-REFERENCE TO RELATED APPLICATIONS

This application claims the benefit of Korean Patent Application No. 2003-14393, filed Mar. 7, 2003, in the Korean Intellectual Property Office, the disclosure of which is incorporated herein by reference.

BACKGROUND OF THE INVENTION

1. Field of the Invention

The present invention relates to an inkjet printer, and more particularly, to a service station system for an inkjet printer capable of maintaining the nozzle surface of a printer head in a good state.

2. Description of the Related Art

In an outer case of an inkjet printer is generally mounted a service station system to wash, protect, and maintain a printer head nozzle surface in a good state. FIG. 1 and FIG. 2 are views schematically illustrating operations of a conventional service station system. As shown in FIGS. 1 and 2, a conventional service station 100 is provided with a pallet 113 disposed underneath a printer head 13 and movable in a horizontal direction, and a pinion 115 and a rack 117 which moves the pallet 113. The pinion 115 rotates in a forward and in a reverse direction by a motor (not shown).

Diverse service parts are mounted on the pallet 113, such as a head cap 121, a wiper 131, and a spittoon 141. The head cap 121 is supported by an elevating member 123 and disposed on an upper front end portion of the pallet 113. A plurality of link members 127 parallel with each other in a vertical direction and a spring 129 are inserted between the elevating member 123 and the pallet 113. By the link members 127 and the spring 129, the elevating member 123 may ascend and descend in one body with the head cap 121 with respect to the pallet 113. An arm 125 extended in a stand-up direction is installed on a front end of the elevating member 123.

The spittoon 141 is constructed with a spitting hole 143 recessed in an upper surface of the pallet 113 and a porous absorber 145 accommodated in the spitting hole 143. The wiper 131 is installed in a stand-up direction on the upper surface of the pallet 113 between the head cap 121 and the spittoon 141. Further, on a rear side of the spittoon 141 is installed a blade 151 fixedly coupled to an additional support device 153 and capable of contacting with the upper surface of the pallet 113. The blade 151, as described later, sweeps into a collector 157 through a drain hole 155, foreign materials and residual ink on a surface of the porous absorber 145 after spitted from the printer head 13.

The conventional service station system 100 for the inkjet printer having the structure as described above starts its operations when the printer head 13 is fixedly placed over the system 100 after a printing job is interrupted or stopped. If the printer head 13, as shown in FIG. 1, is fixedly positioned over the service station system 100, the motor rotates the pinion 115 clockwise to retreat the pallet 113 with respect to the printer head 13. When the pallet 113 retreats, the wiper 131 removes the residual ink and the foreign materials while contacting with a nozzle face of the printer head 13.

Meanwhile, if retreat of the pallet 113 is nearly completed, the arm 125 of the elevating member 123 comes in contact with the printer head 13. At this time, the pallet 113 continues to retreat, but the elevating member 123 stops moving by the arm 125 stuck on the printer head 13, and the elevating member 123 ascends by the link members 127 accordingly.

If the elevating member 123 ascends, the head cap 121 also ascends in one body with the member 123. The ascending head cap 121 gradually seals the nozzle face of the printer head 13, and thereafter, if the nozzle face of the printer head 13 is completely sealed, the pinion 115 stops its clockwise rotation. Here, a sealing state of the printer head 13 by the head cap 121 continues until a subsequent printing command is inputted.

Meanwhile, if the printing command is inputted, the pinion 115 rotates counterclockwise by the motor before the printer head 13 moves to a printing position. With the rotations of the pinion 115, the pallet 113 moves forward, the elevating member 123 descends, and at the same time, the printer head 13 is being uncapped. Next, the nozzle face of the printer head 13 is wiped by the wiper 131 of the pallet 113 which keeps moving forward.

Thereafter, if the printer head 13 moving forward is positioned over the spittoon 141, the pinion 115 stops rotating counter-clockwise. Subsequently, during an interruption or a stopping of the printing job, a spitting job is carried out to remove ink or foreign materials firmly stuck on the nozzle face of the printer head 13. After spitting, residual ink left on the upper surface of the porous absorber 145 is swept by the blade 151 when the pallet 113 moves. Next, the printer head 13 moves to perform the printing job according to an input command.

However, the conventional service station system 100 for an inkjet printer has a problem in that its volume inevitably becomes large since enough space must be secured in order for the pallet 113 to reciprocate. That is, the conventional service station system 100 has to have enough space therein for movements of the pallet 113 since capping or uncapping, wiping, sweeping, and spitting sequentially progress on the same line the pallet 113 moves in order to maintain the printer head in a good state. Such a problem is particularly dominant on a service station system having the pallet 113 which services on the nozzle face while moving in a direction perpendicular to a printing direction of the printer head 13, which becomes a factor of having to increase the volume of an inkjet printer in front and rear sides in the future.

SUMMARY OF THE INVENTION

Accordingly, it is an aspect of the present invention is to provide a compact and small-sized service station system for an inkjet printer capable of capping or uncapping, wiping, and spitting in a systematic and harmonious fashion in a small space.

It is another aspect of the present invention to set up a compact and small-sized service station system in an inkjet printer, to thereby decrease a volume of the inkjet printer from a front to rear thereof.

Additional aspects and advantages of the invention will be set forth in part in the description which follows and, in part, will be obvious from the description, or may be learned by practice of the invention.

The foregoing and/or other aspects of the invention are achieved by providing a service station system for an inkjet printer which comprises head caps to revolve between a capping position and an uncapping position of printer heads, a slider to slide with respect to the head caps, and having wipers mounted on a front end portion thereof, a slider movement unit to slide the slider, a revolution unit disposed between the head caps and the slider to revolve the head caps in association with the sliding of the slider with respect to the head caps.

According to an aspect of the invention, the revolution unit includes a shaft disposed under the printer heads in a traverse direction with respect to a sliding direction of the slider, a revolving member to revolve on the shaft, and being coupled with the head caps thereon, and links, each hingedly coupled to the revolving member and the slider to revolve the revolving member while interlocking with the slider, to thereby have a simple structure.

According to an aspect of the invention, the slider movement unit includes a rack provided on an upper surface of the slider along the sliding direction, a pinion disposed over the slider and meshed with the rack, and a motor to rotate the pinion, to thereby have a simple structure.

According to an aspect of the invention, the slider of the service station system slides in a perpendicular direction to a printing direction of the printer heads.

BRIEF DESCRIPTION OF THE DRAWINGS

The above and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
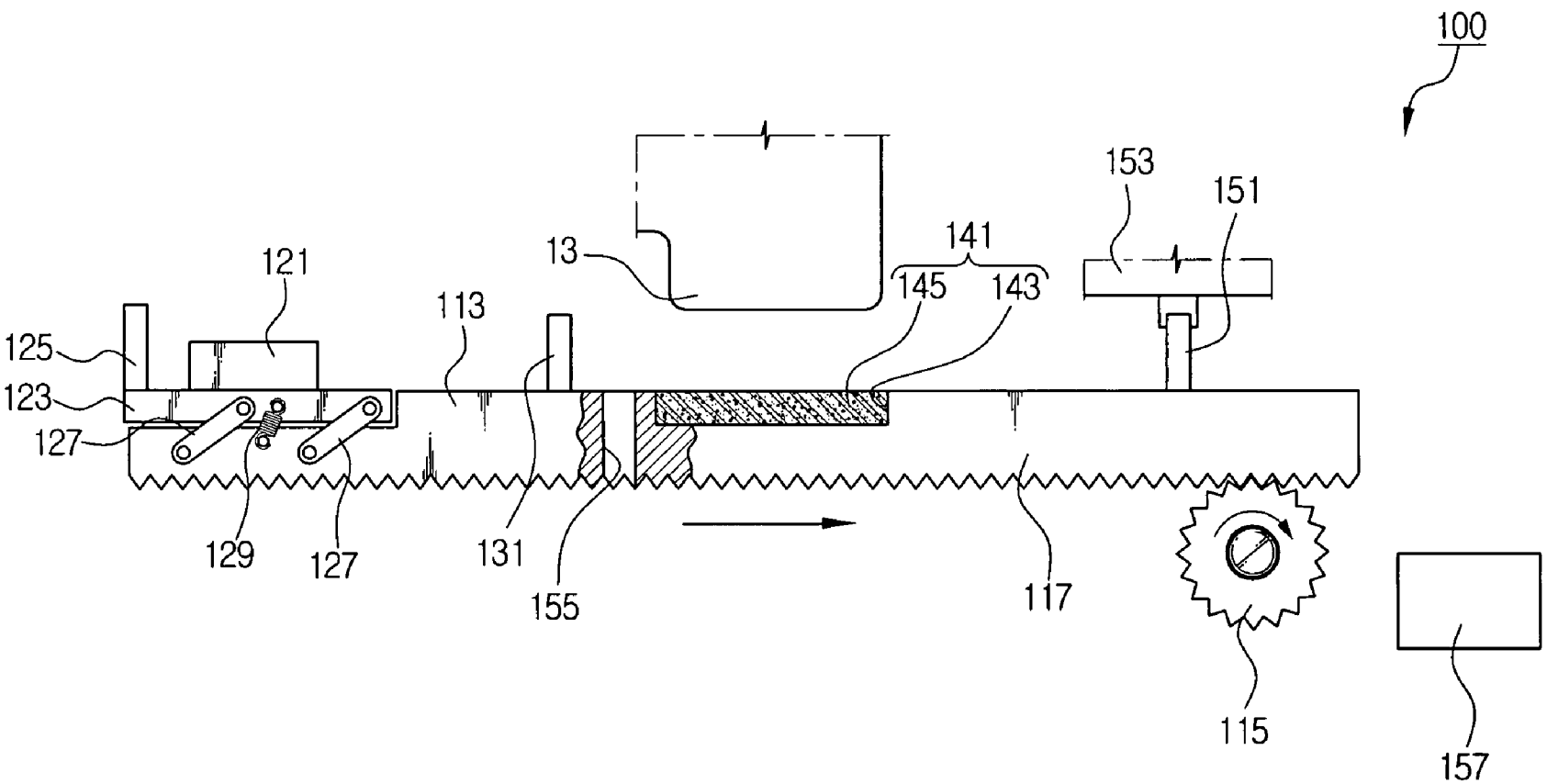
FIG. 1 (PRIOR ART)
FIG. 1 and FIG. 2 are views schematically illustrating operations of a conventional service station system for an inkjet printer.
Figure 2:
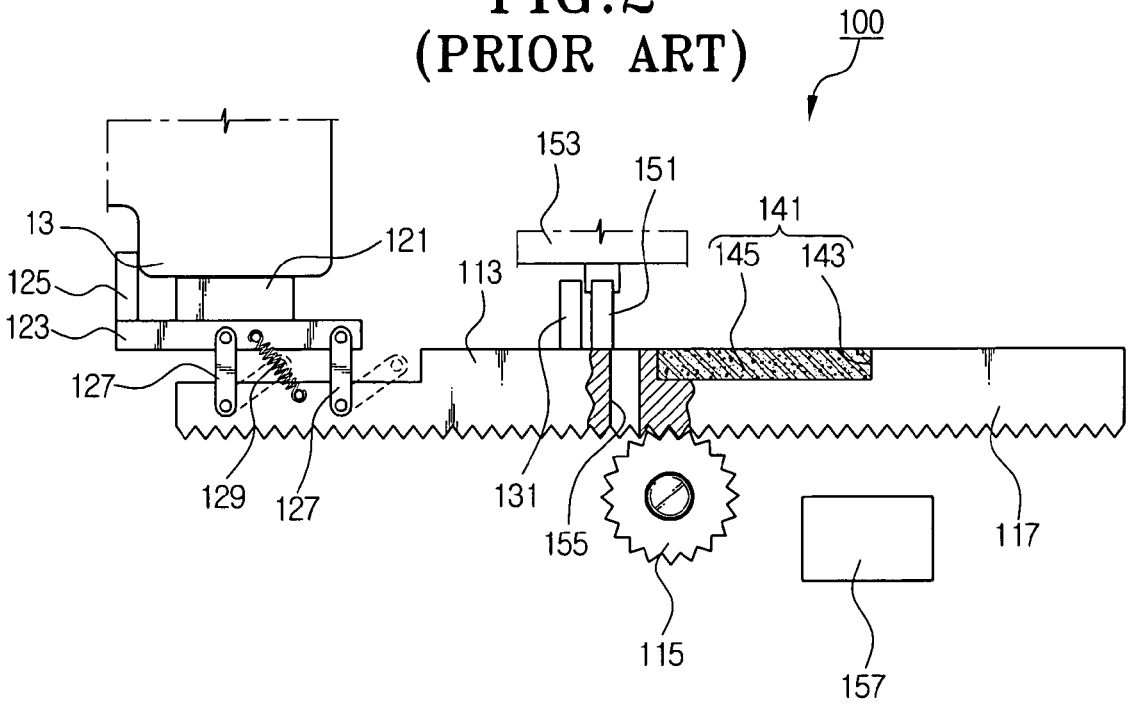
FIG.2 (PRIOR ART)

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 3:
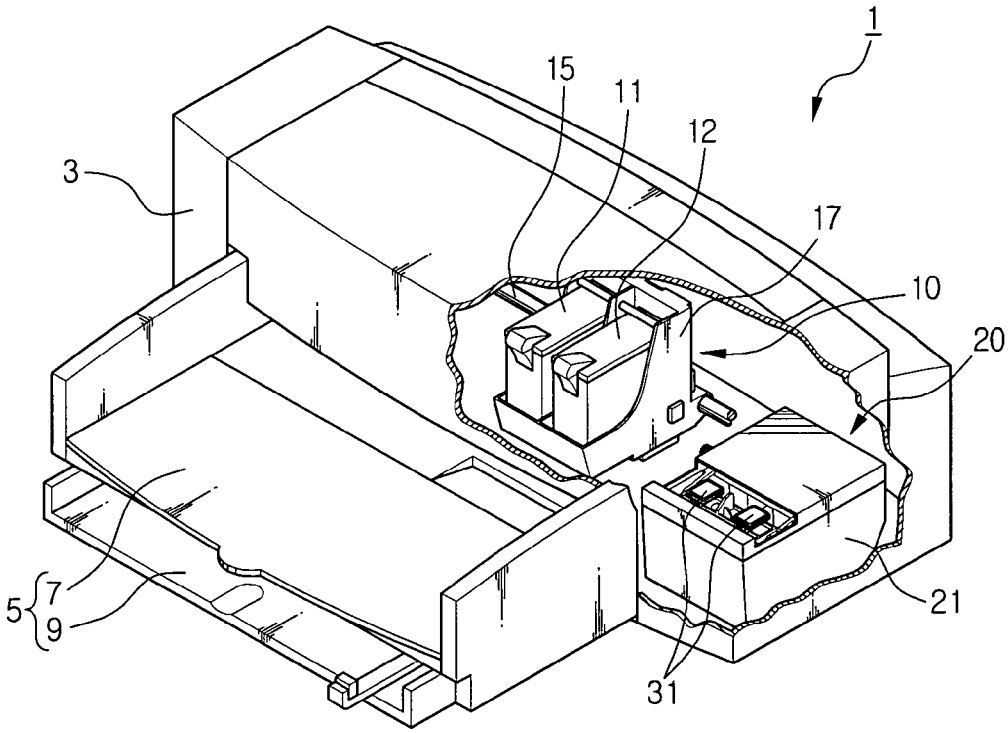
FIG. 3 is a partially cut-off perspective view of an inkjet printer in which a service station system is mounted, according to an embodiment of the present invention.

FIG. 3 is a partially cut-off perspective view of an inkjet printer in which a service station system is mounted, according to an embodiment of the present invention. The ink-jet printer 1 is provided with an exterior case 3 in which a printing unit 10 and a service station system 20 is mounted, and a paper cassette 5 detachably coupled to the exterior case 3. The paper cassette 5 includes a supply tray 9 in which sheets of paper are loaded and a discharge tray 7 to hold printed sheets. Sheets supplied from the supply tray 9 are printed through the printing unit 10 and fed into the discharge tray 7.

The printing unit 10 is mainly constructed with a guide rail 15 fixed transversely with respect to a sheet feeding direction, a carrier 17 to reciprocate along the guide rail 15, and a pair of monochrome and color cartridges 11 and 12 exchangeably coupled to the carrier 17. The carrier 17 may reciprocate by a pulley and a timing belt which rotate by a feeding motor (not shown). The carrier 17 moves to and waits at one side of the guide rail 15 in a case in which a printing job of the printer is interrupted or stopped.

The monochrome and color cartridges 11 and 12 are respectively coupled on left and right sides of the carrier 17. The carrier 17 exposes the nozzle faces of printer heads 13 of the respective cartridges 11 and 12 through a lower side thereof. Accordingly, head caps 31 of the service station system 20, to be described later in detail, may approach on a side of the exposed nozzle faces of the printer heads 13 from a lower position.

Figure 4:
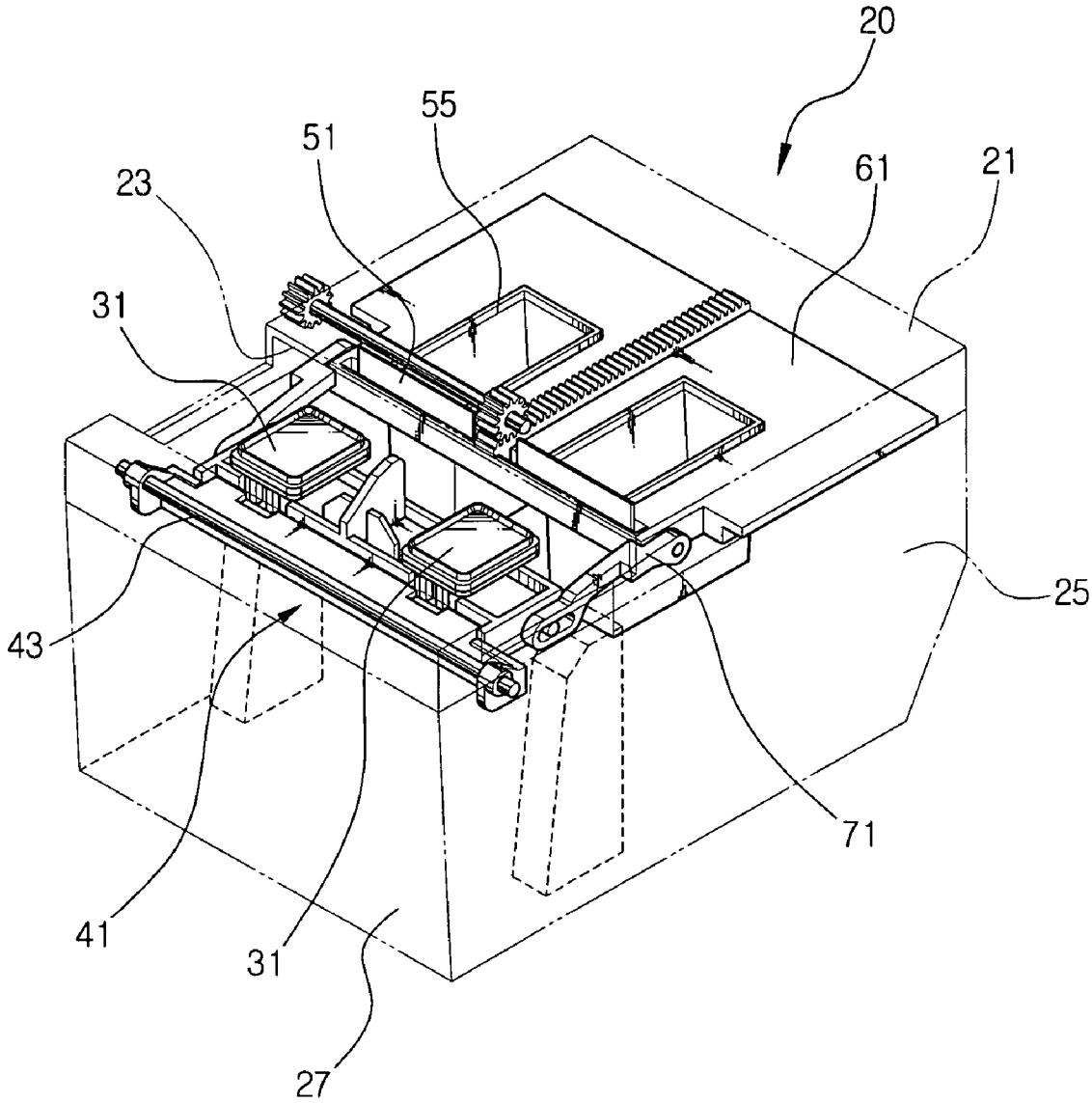
FIG. 4 is a partially enlarged perspective view of FIG. 3, showing the service station system.

FIG. 4 is a perspective view showing the service station system 20 for the ink-jet printer 1. The service station system 20 is provided with a nearly cube-shaped casing 21. An entrance 23 opened for the head caps 31 is provided on an upper surface of the casing 21, and, if the carrier 17 waits over the upper surface, the entrance 23 faces the printer head 13. The casing 21 of the service station system 20 is disposed in parallel with a sheet feeding direction. In other words, the casing 21 is provided in a direction perpendicular to a printing direction of the carrier 17, and the printer head 13 of the cartridges 11 and 12 coupled with the carrier 17.

Figure 5:
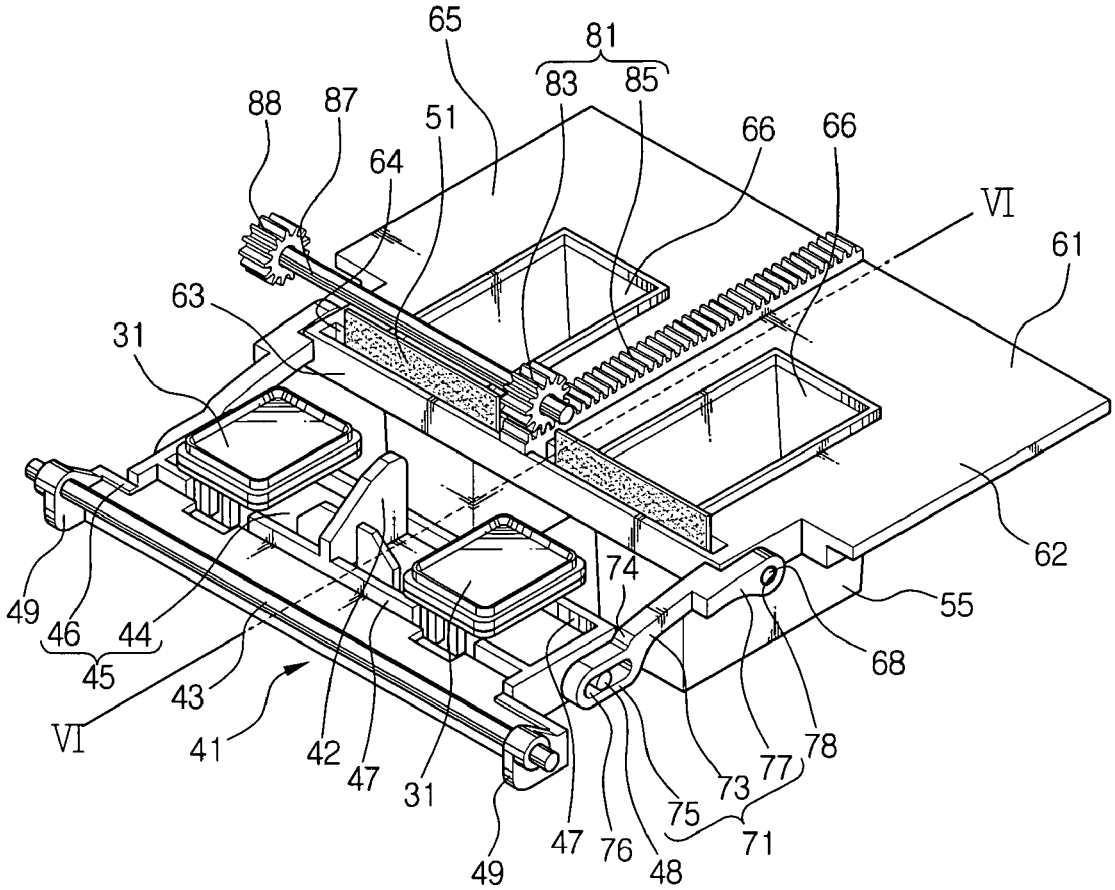
FIG. 5 is an enlarged view of main parts of FIG. 4, showing in more detail a structure of the service station system.
Figure 6:
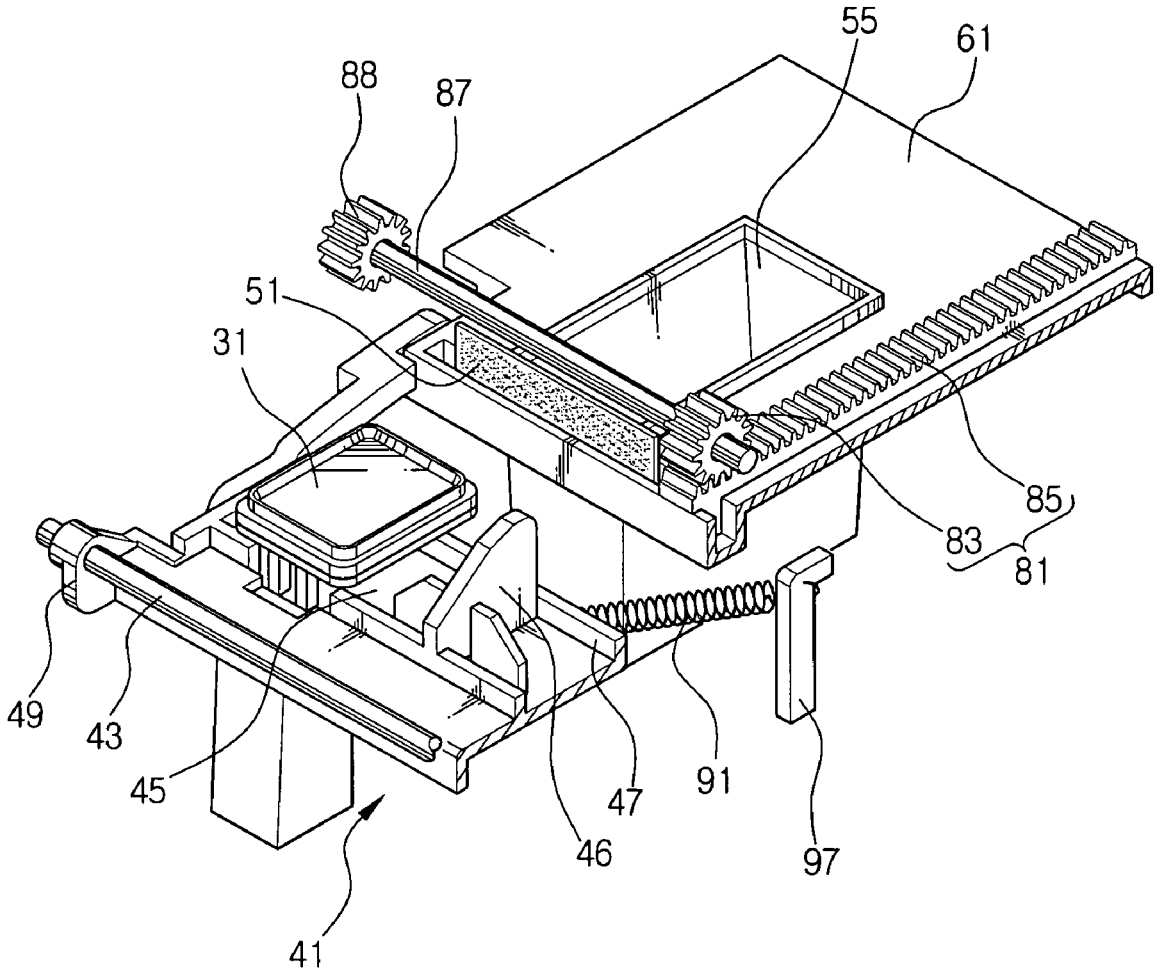
FIG. 6 is a view taken along lines VI-VI of FIG. 5.

FIG. 5 is a partially enlarged view of the service station system 20, showing in more detail main parts mounted in the casing 21. Referring to FIG. 5, the service station system 20 includes the head caps 31 to cap the printer heads 13, a slider 61 having wipers 51 to wipe the printer heads 13 and spittoons 55 to spit, a slider movement unit 81 to reciprocatably slide the slider 61, and a revolution unit 41 to convert the sliding of the slider 61 into an up-and-down revolving of the head caps 31.

The revolution unit 41 is constructed with a revolving member 45 with which the head caps 31 are coupled, a shaft 43 to couple the revolving member 45 to move upward and downward in the casing 21, and links 71 to connect the revolving member 45 and the slider 61. Both ends of the shaft 43 are rotatably coupled on walls 25 of both sides of the casing 21, respectively. The shaft 43 is preferably mounted in front of the entrance 23 provided on the casing 21.

The revolving member 45 may be sectioned into a plate 44 on which a pair of the head caps 31 is mounted, and a connecting portion 46 provided on a front end of the plate 44. The connecting portion 46 may be simply constructed with a pair of ribs 49 to protrude forward from the front end of the plate 44 and disposed opposite to each other. The ribs 49 each have a shaft opening, so that the revolving member 45 is coupled with the shaft 43 connected on the side walls 25 of the casing 21. Accordingly, the revolving member 45 may revolve upward and downward on the shaft 43, and, at this time, the plate 44 goes forth and withdraws from the surface of the entrance 23.

The revolving member 45 constructed with the plate 44 and the connecting portion 46 including the pair of ribs 49 may be simply injection-molded in one body. Further, the shaft 43 may be separated from the revolving member 45, but the shaft 43 and the revolving member 45 may be formed in one body. That is, instead of forming shaft openings in the respective ribs 49, the shafts may be protruded outward from the respective ribs 49 and rotatably coupled on the side walls 25 of the casing 21.

On the upper surface of the plate 44 is installed the pair of head caps 31 to cap the printer head 13 of the monochrome cartridge 11 and the printer head 13 of the color cartridge 12, respectively. General descriptions on the substance and structure of the head caps 31, and the connection structure of the plate 44 and the head caps 31 are omitted. On the upper surface of the plate 44 is provided a rib 42 to partition a predetermined space to mount the head caps 31 from side to side, and ribs 47 to reinforce strength.

Accordingly, the head caps 31 revolve between an external exposure position through the entrance 23 of the casing 21 and a shield position, and moves with the revolving member 45 revolving upward and downward. The head caps 31 exposed through the entrance 23 of the casing 21 cap the nozzle face of the printer heads 13, and the head caps 31 at the shield position uncap the nozzle face of the printer heads 31. The links 71 to revolve the head caps 31 will be described later in connection with descriptions on the slider 61.

The slider 61 has nearly a rectangular plate shape, and is provided with a wiper connecting portion 63 to which the wipers 51 are coupled, and a spittoon connecting portion 65 to which the spittoons 55 are installed. On interior walls of the casing 21 are provided sliding grooves to slidably accommodate both sliding sides 62 of the slider 61, respectively. The sliding grooves are opposite to each other in parallel in a horizontal direction, and extended along a lengthened direction between a front wall 27 and a rear wall of the casing 21.

The wiper connecting portion 63 includes a pair of slits 64 on the left and right thereof which are recessed along a front side of the slider 61. Each of the slits 64 is preferably provided to match with the printer heads 13 of the respective cartridges 11 and 12, and the wipers 51 made of an elastic substance are fixedly coupled to the slits 64, respectively. Descriptions on the substance and structure of the wipers 51 will be omitted since they are well known to those skilled in the art.

The spittoon connecting portion 65 is provided with a pair of spitting holes 66 on the left and right sides of the slider 61. The spitting holes 66 are preferably provided to match with the respective slits 64 of the wiper connecting portion 63. Further, the spittoons 55 are coupled in the spitting holes 66 respectively, and slide in one body with the slider 61. The porous absorber (reference number 145 in FIG. 1) is mounted in the spittoons 55, respectively, so that liquid ink may be absorbed which is spitted from nozzles of the printer heads 13.

The links 71 connecting the slider 61 and the revolving member 45 each include a driving hinge part 77 and a moving hinge part 75 provided on both ends, respectively, of a body 73. A step part 74 is provided between the moving hinge part 75 and the body 73, which is inclined downward the moving hinge part 75. The body 73, the driving hinge part 77, and the moving hinge part 75 may be simply injection-molded in one body.

Hinge holes 78 and 76 are provided in a horizontal direction in the driving hinge part 77 and the moving hinge part 75, respectively. Due to a structure of the moving hinge part 75, the first hinge hole 78 provided in the driving hinge part 77 is disposed at a higher position than the second hinge hole 76 provided in the moving hinge part 75. The second hinge hole 76 of the moving hinge part 75 is in the form of an extended hole in a lengthened direction of the link 71.

The first hinge hole 78 is rotatably coupled to a first hinge shaft 68 protruded on one side of the slider 61, and the second hinge hole 76 is rotatably coupled to a second hinge shaft 48 protruded on one side of the revolving member 45. The second hinge shaft 48 is preferably provided at a lower position than the first hinge shaft 68 in a state in which the slider 61 and the revolving member 45 are disposed in parallel.

The structures of the hinge shafts 48 and 68 and the hinge holes 76 and 78 have an advantage in revolving the revolving member 45 upward and downward with respect to the nozzle faces of the printer heads 13. That is, if the slider 61 approaches the revolving member 45, the links 71 revolve on the first hinge shaft 68 of the slider 61 so as to revolve the revolving member 45 on the shaft 43. The revolution of the links 71 are guided by the guide 93 (refer to FIG. 7) protruded from a bottom of the casing 21 between the revolving member 45 and the slider 61.

An upper end portion of the guide 93 contacting with the links 71 is bent. Meanwhile, the links 71, that is, a bottom surface of the stepped part 74 contacting with a bent upper end portion 95 of the guide 93, are also bent. The bent portions 79 and 95 smoothly guide the upward and downward revolutions of the revolving member 45 while contacting with each other as the links 71 revolve. The smooth upward and downward revolutions of the revolving member 45 are also revolved by a compression coil spring 91.

The compression coil spring 91 has one end coupled to a central area of a rear side of the revolving member 45 and the other end coupled to a fixed rib 97 protruded upward from the bottom surface of the casing 21. The fixed rib 97 and the guide 93 are spaced in a certain interval. The compression coil spring 91 has an elastic restoration force when the revolving member 45 uncaps revolution and prevents the revolving member 45 from an excessive capping revolution.

A slider movement unit 81 is constructed with a rack 85 mounted on an upper side of the slider 61, a pinion 83 rotatably installed at a fixed position over the slider 61 and meshed with the rack 85, and a motor (not shown) to rotate the pinion 83. A gear 88 and a rotation shaft 87 may be further included to transfer a driving force of the motor to the pinion 83. The motor may be installed outside the casing 21. In such a case, the gear 88 coupled on one end of the rotation shaft 87 externally exposed through the casing 21 is meshed with gears (not shown) connected with the motor, so that the driving force of the motor may be transferred to the pinion 83.

The service station system 20 for the inkjet printer 1 having the above-described structure performs wiping and capping operations after a printing job is interrupted and stopped, and the carrier 17 stays at a waiting position, that is, at an upper position of the casing 21. Further, before the carrier 17 moves for the printing job according to a printing start command, the service station system 20 successively implements uncapping, wiping, and spitting.

Hereinafter, operations of the service station system 20 are described in detail with reference to FIG. 7 through FIG. 10.

Figure 7:
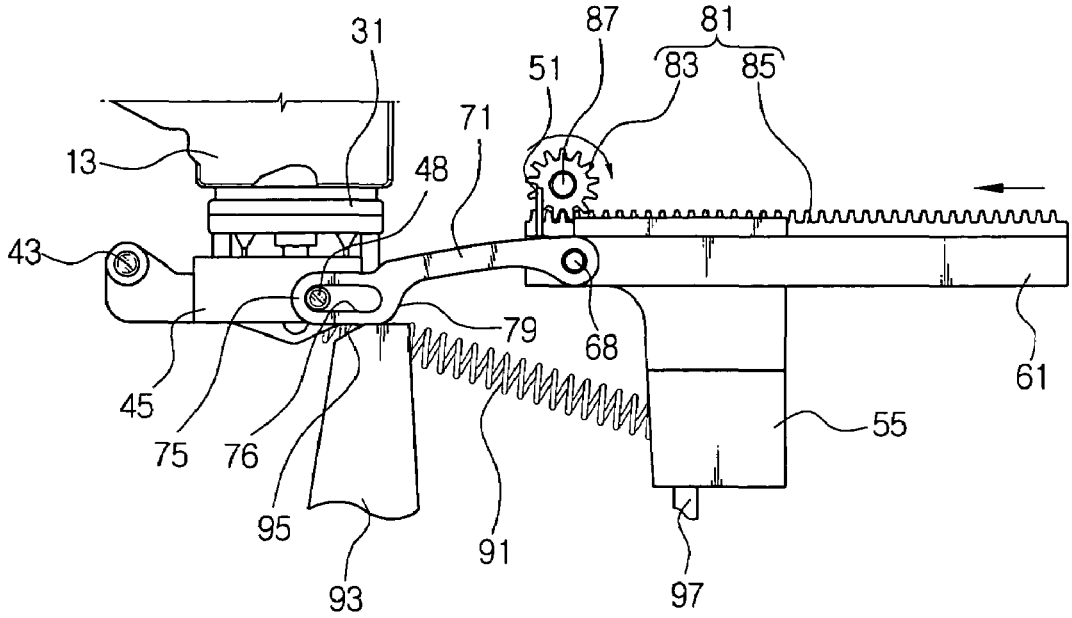
FIG. 7 is a side view of FIG. 5, showing a state in which a nozzle face of a printer head is capped with a head cap.

FIG. 7 is a side view of FIG. 5, showing a state that the nozzle face of the printer head 13 is capped with the head cap 31. In FIG. 7, the carrier 17 is placed at the waiting position before the printing command is inputted, and, at this time, the printer head 13 remains capped. The capping may seal and protect the nozzle of the printer head 13 from external pollutants or dry atmosphere. In such a state, the compression coil spring 91 is also expanded so that a restoration force is applied in a direction of moving the revolving member 45 downward.

If the printing command is inputted, the pinion 83 rotates clockwise to move the slider 61 toward the revolving member 45. Accordingly, the link 71 moves forward, so the second hinge shaft 48 of the revolving member 45 relatively moves toward the slider 61 along the second hinge hole 76 formed of the extended hole in the moving hinge part 75 of the link 71.

Figure 8:
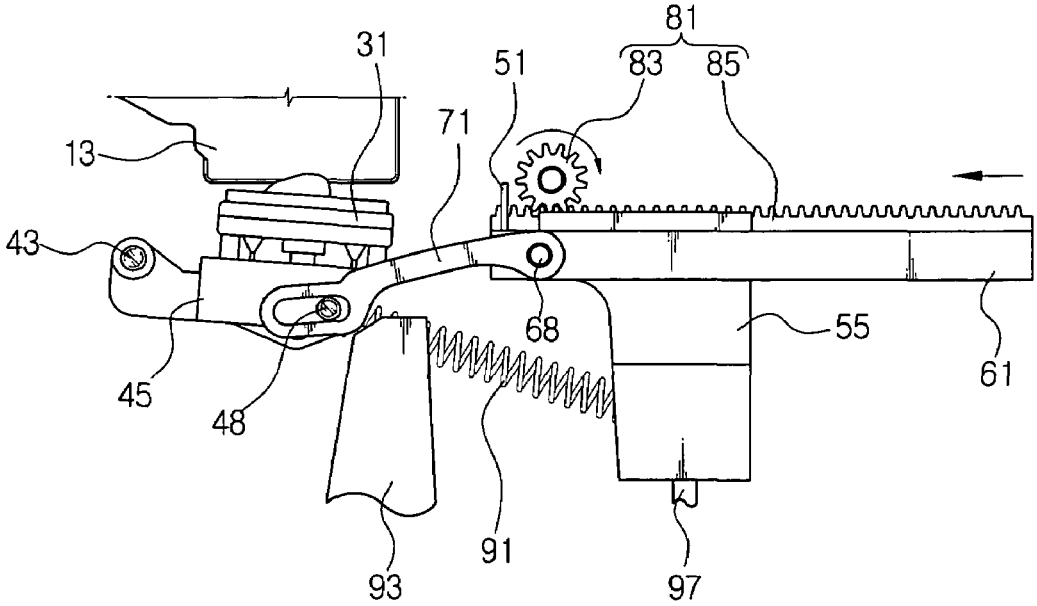
FIG. 8 through FIG. 10 are operation state views of FIG. 7 to explain operations of the service station system for the inkjet printer.

As shown in FIG. 8, if the second hinge shaft 48 cannot move any further, the link 71 starts downward revolution on the first hinge shaft 68. The revolving member 45 associated with the link 71 also revolves downward on the shaft 43. Then the head cap 31 capping the printer head 13 revolves downward in one body with the revolving member 45, so that the capping state is released. FIG. 8 shows a state that the head cap 31 revolving in one body with the revolving member 45 gradually opens the printer head 13. The link 71 is guided to revolve down by the guide bar 93 and the compression coil spring 91.

Figure 9:
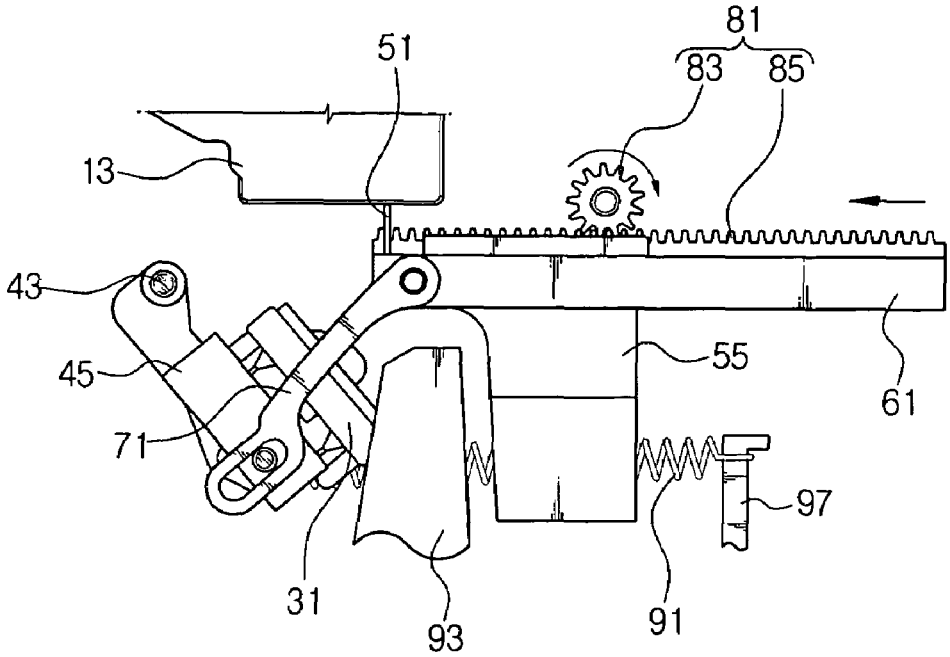
Figure 10:
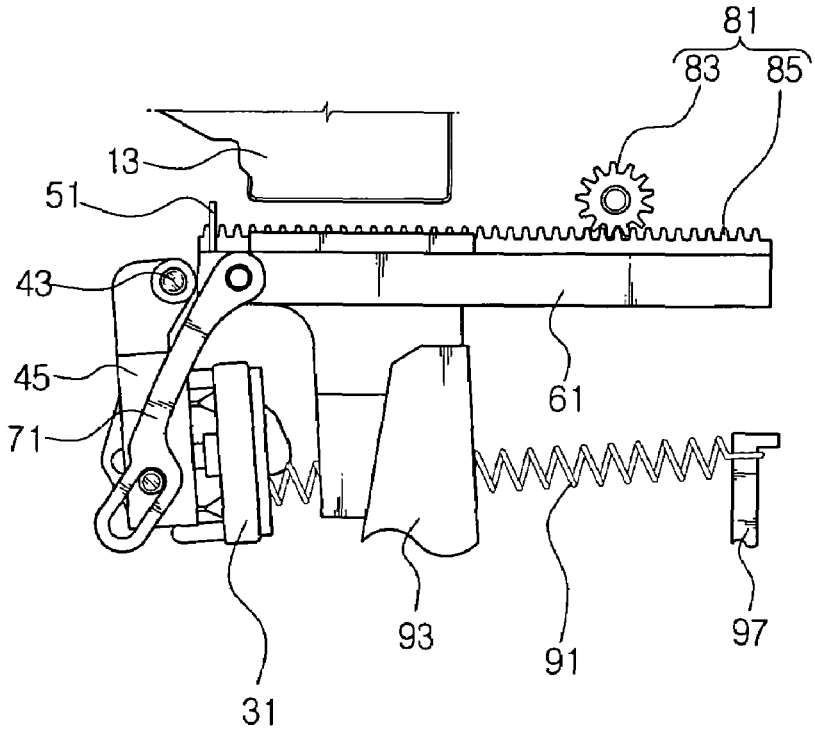

Thereafter, the slider 61 keeps moving forward, so that the link 71 becomes spaced apart from the guide 93, as shown in FIG. 9. The wiper 51 coupled to the slider 61 wipes the nozzle face of the printer head 13 clean. Even after the cleaning, the slider 61 continues to move forward. As shown in FIG. 10 the forward and reverse rotations of the pinion 83 are stopped and the printer head 13 is completely uncapped.

Also, as shown in FIG. 10, in a state in which the printer head 13 is completely uncapped, the spittoon connecting portion 65 is placed vertically under the printer head 13. Then the printer head 13 carries out the spitting to remove ink and foreign materials firmly stuck on the nozzle face thereof. If the spitting is completed, the carrier 17 moves the cartridges 11 and 13 to the printing position for the printing job.

If the carrier 17 stays at the print waiting position, that is, the carrier 17 moves over the service station system 20 so its position is fixed, after the printing job is interrupted or stopped, the pinion 83 starts rotating counterclockwise. Then the wiping and capping are implemented in the reverse of the aforementioned order, which becomes a series of maintenance jobs for wiping and protecting the printer head 13.

Further, even though not described in the service station system 20 of the embodiments stated and shown above, the upper side of the slider 61 is preferably provided with a drain hole 155 and a blade 151 as described in connection with FIG. 1 of the prior art. Then, the blade 151 may remove foreign materials remaining on the porous absorber 143 after spitting is done.

As aforementioned, the present invention may reduce work space to wash and protect the printer heads since the revolving member on which head caps are mounted revolves in the sliding space for a slider on which wipers and spittoons are mounted, thereby providing a small-sized and compact service station system for an inkjet printer.

Further, with adoptions of the small-sized and compact service station system according to the present invention, an excellent effect may be provided to greatly reduce the volume of an inkjet printer from front to rear.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A service station system for an inkjet printer, comprising:

head caps to revolve between a capping position and an uncapping position of printer heads;

a slider to slide with respect to the head caps, and having wipers mounted on a front end portion thereof;

a slider movement unit to slide the slider; and a revolution unit disposed between the head caps and the slider to revolve the head caps in association with the sliding of the slider with respect to the head caps, the revolution unit including a shaft disposed under the printer heads in a traverse direction with respect to a sliding direction of the slider, a revolving member to revolve on the shaft and coupled with the head caps thereon, and links, each hingedly coupled to the revolving member and the slider, to activate the revolving member while interlocking with the slider.

2. The service station system as claimed in claim 1, further comprising:

a first hinge shaft to protrude on a side of the slider; and a second hinge shaft to protrude on a side of the revolving member, wherein the second hinge shaft is located a position lower than the first hinge shaft when the slider and revolving member are disposed in parallel to each other.

3. The service station system as claimed in claim 2, further comprising:

a guide to guide the revolving of the body and disposed between the slider and the revolving member.

4. The service station system as claimed in claim 1, wherein each of the links comprises:

a body;

a driving hinge part having a first hinge hole on one end portion thereof to be engaged with the first hinge shaft of the slider; and a moving hinge part having a second hinge hole disposed lower than the first hinge hole on the other end portion thereof to be engaged with the second hinge shaft of the revolving member.

5. The service station system as claimed in claim 4, wherein the body revolves the revolving member upward and downward on the shaft while revolving on the first hinge shaft of the slider, and the second hinge hole of the moving hinge part is a long opening lengthened in a direction of the body.

6. The service station system as claimed in claim 5, further comprising:

a spring to restore the revolving member to the capping position, one end of the spring being fixed to the revolving member, and the other end of the spring being fixed to a rear side spaced in a certain interval from the revolving member.

7. The service station system as claimed in claim 1, further comprising:

a spring to restore the revolving member to the capping position, one end of the spring being fixed to the revolving member, and the other end of the spring being fixed to a rear side spaced in a certain interval from the revolving member.

8. The service station system as claimed in claim 1, wherein the slider slides in a perpendicular direction with respect to a printing direction of the printer heads.

9. The service station system as claimed in claim 8, further comprising:

a first hinge shaft to protrude on a side of the slider; and a second hinge shaft to protrude on a side of the revolving member, wherein the second hinge shaft is located a position lower than the first hinge shaft when the slider and revolving member are disposed in parallel to each other.

10. The service station system as claimed in claim 9, wherein each of the links comprises:

a body;

a driving hinge part having a first hinge hole on one end portion thereof to be engaged with the first hinge shaft of the slider; and a moving hinge part having a second hinge hole disposed lower than the first hinge hole on the other end portion thereof to be engaged with the second hinge shaft of the revolving member.

11. The service station system as claimed in claim 10, further comprising:

a step part provided between the moving hinge part and the body, and inclined downward with respect to the moving hinge part.

12. The service station system as claimed in claim 11, further comprising:

a guide to guide a revolving of the body and disposed between the slider and the revolving member, wherein a portion of the guide is bent.

13. The service station system as claimed in claim 12, wherein the step part comprises a bent portion to contact with the bent portion of the guide, to smoothly guide the upward and downward moving of the revolving member.

14. A service station system for an inkjet printer, comprising:

head caps to revolve between a capping position and an uncapping position of printer heads;

a slider to slide with respect to the head caps, and having wipers mounted on a front end portion thereof;

a slider movement unit to slide the slider, the slider movement unit including a rack provided on an upper surface of the slider along a sliding direction, a pinion disposed over the slider and meshed with the rack, and a motor to rotate the pinion; and a revolution unit disposed between the head caps and the slider to revolve the head caps in association with the sliding of the slider with respect to the head caps.

15. A service station system for an inkjet printer, having a casing provided in a direction perpendicular to a printing direction of a carrier of the inkjet printer, comprising:

head caps to revolve between a capping position and an uncapping position of printer heads;

an entrance provided on a surface of the casing to face the printer heads;

a slider to slide with respect to the head caps, and having wipers to wipe the printer heads and spittoons to remove ink from the printer heads;

a slider movement unit to slide the slider; and a revolution unit disposed between the head caps and the slider to revolve the head caps in association with the sliding of the slider with respect to the head caps, the revolution unit including a revolving member to couple to the head caps, a shaft to couple to the revolving member to move upward and downward in the casing, and mounted in front of the entrance of the casing, and links to connect the revolving member and the slider.

16. The service station system as claimed in claim 15, wherein the revolving member is sectioned into a plate on which the head caps are mounted, and a connecting portion provided on the plate.

17. The service station system as claimed in claim 16, wherein the connecting portion comprises a pair of ribs to protrude forward from an end of the plate and disposed opposite to each other.

18. The service station system as claimed in claim 17, wherein the ribs each comprises a shaft opening, so that the revolving member is coupled with the shaft of the revolution unit.

19. The service station system as claimed in claim 15, wherein the slider comprises:

a wiper connecting portion coupled to the wipers and having a pair of slits recessed along a side of the slider; and a spittoon connecting portion provided with a pair of spitting holes on opposite sides of the slider, wherein the spitting holes of the spittoon connecting portion are aligned with the slits of the wiper connecting portion.

* * * * *